US011142426B2

(12) United States Patent
Miyazaki

(10) Patent No.: US 11,142,426 B2
(45) Date of Patent: Oct. 12, 2021

(54) SHEET PROCESSING DEVICE

(71) Applicant: KYOCERA Document Solutions Inc., Osaka (JP)

(72) Inventor: Masahiko Miyazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 214 days.

(21) Appl. No.: 16/662,567

(22) Filed: Oct. 24, 2019

(65) Prior Publication Data

US 2020/0130977 A1 Apr. 30, 2020

(30) Foreign Application Priority Data

Oct. 31, 2018 (JP) ..... JP2018-205420

(51) Int. Cl.
*B65H 43/00* (2006.01)
*B65H 31/30* (2006.01)

(52) U.S. Cl.
CPC ..... *B65H 43/00* (2013.01); *B65H 31/3027* (2013.01); *B65H 2404/152* (2013.01); *B65H 2404/1521* (2013.01); *B65H 2407/10* (2013.01); *B65H 2511/511* (2013.01); *B65H 2513/512* (2013.01); *B65H 2553/612* (2013.01); *B65H 2553/81* (2013.01); *B65H 2801/27* (2013.01)

(58) Field of Classification Search
CPC ..... B65H 43/00; B65H 31/3027; B65H 2553/612; B65H 2553/81; B65H 2404/152; B65H 2407/10; B65H 2511/511
See application file for complete search history.

(56) References Cited

U.S. PATENT DOCUMENTS 3,840,224 A * 10/1974 Zawiski ..... B65H 27/00 271/263
9,045,297 B2 * 6/2015 Takamori ..... B65H 1/14

FOREIGN PATENT DOCUMENTS

JP H06345319 A 12/1994

* cited by examiner

*Primary Examiner* — Patrick Cicchino
(74) *Attorney, Agent, or Firm* — Studebaker & Brackett PC

(57) ABSTRACT

The sheet processing device includes a processing tray, a processing device, a discharge port, a discharge rollers pair, a supporting arm and an interlock mechanism. The discharge rollers pair has a lower roller and an upper roller. The supporting arm supports the upper roller and is turnable between a first position where the upper roller comes into contact with the sheet and a second position where the upper roller separates upwardly from the sheet. The interlock mechanism includes an actuator, a switch and a switch moving mechanism. The actuator is turned with an upwardly turning of the supporting arm. The switch detects the actuator to detect that the supporting arm is turned to the second position. The switch moving mechanism moves the switch to a switch non-detective position when the processing is not performed and moves the switch to a switch detective position when the processing is performed.

10 Claims, 6 Drawing Sheets

SHEET PROCESSING DEVICE

INCORPORATION BY REFERENCE

This application is based on and claims the benefit of priority from Japanese patent application No. 2018-205420 filed on Oct. 31, 2018, which is incorporated by reference in its entirety.

BACKGROUND

The present disclosure relates to a sheet processing device to perform a processing containing a stapling processing where a stack of sheets is stapled.

A sheet processing device to perform a stapling processing or other processing is provided with a processing tray on which a sheet switched back through a discharge port is stacked to form a stack of the sheets to be processed. In view of safety in the sheet processing device performing the stapling processing, the sheet processing device is sometimes provided with a foreign matter detection device which detects an object existing above a bin tray (the processing tray). The foreign matter detection device includes a foreign matter detection bar which is disposed above the bin tray in a forward and backward movable manner. When a foreign matter enters above the bin tray, the forward moving of the foreign matter detection bar is restricted to make it impossible to switch a foreign matter detection switch from an OFF state to an ON state and then it is determined whether abnormality occurs or not.

However, the above foreign matter detection device has a problem that a mechanism to move the foreign matter detection bar forward and backward has a complicate structure.

On the other hand, the sheet processing device provided with an interlock mechanism using a switch is known. The switch is switchable to an ON state and an OFF state by an actuator supported at the discharge port in a turnable manner. The switch is switched from the OFF state to the ON state to make it possible to perform the stapling processing. The switch is switched from the ON state to the OFF state to make it impossible to perform the stapling processing. The switch is switched from the OFF state to the ON state when the actuator is turned to close the discharge port. The switch is switched from the ON state to the OFF state when the actuator is turned to open the discharge port.

In the above sheet processing device, when a second or subsequent sheet is conveyed, the actuator is turned to open the discharge port and the switch is switched from the ON state to the OFF state, and when the sheet is switched back, the actuator is turned to close the discharge port and the switch is switched from the OFF state to the ON state. If a foreign matter enters through the discharge port, the actuator is pushed by the foreign matter and turned to open the discharge port. Then, the switch is switched from the ON state to the OFF state to make it impossible to perform the stapling processing.

As described above, every time when one sheet is conveyed, the switching to the ON state and the OFF state is repeated. Recent years, a request for stapling of a large number of sheets (for example, 100 sheets) is increased. In this case, if the switching to the ON state and the OFF state is repeated every time when one sheet is conveyed, the life of the switch becomes short. In some cases, the life of the switch becomes shorter than a life of a stapler.

SUMMARY

In accordance with an aspect of the present disclosure, a sheet processing device includes a processing tray, a processing device, a discharge port, a discharge rollers pair, a supporting arm and an interlock mechanism. On the processing tray, a sheet is stacked. The processing unit performs a predetermined processing on the sheet on the processing tray. Through the discharge port, the processed sheet is discharged. The discharge rollers pair has a lower roller provided in the discharge port and an upper roller facing the lower roller. The discharge rollers pair conveys the sheet on the processing tray. The supporting arm supports the upper roller and is provided to be turnable between a first position where the upper roller comes into contact with the sheet and a second position where the upper roller separates upwardly from the sheet. The interlock mechanism stops a performing of the processing by the processing unit when a turning of the supporting arm to the second position is detected. The interlock mechanism includes an actuator, a switch and a switch moving mechanism. The actuator is supported in the discharge port in a turnable manner and turned with an upwardly turning of the supporting arm. The switch detects the actuator to detect that the supporting arm is turned to the second position. The switch moving mechanism moves the switch to an actuator non-detective position and an actuator detective position. The switch moving mechanism moves the switch to the non-detective position when the processing is not performed and moves the switch to the detective position when the processing is performed.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a sheet processing device according to an embodiment of the present disclosure will be described with reference to the drawings.

Figure 1:
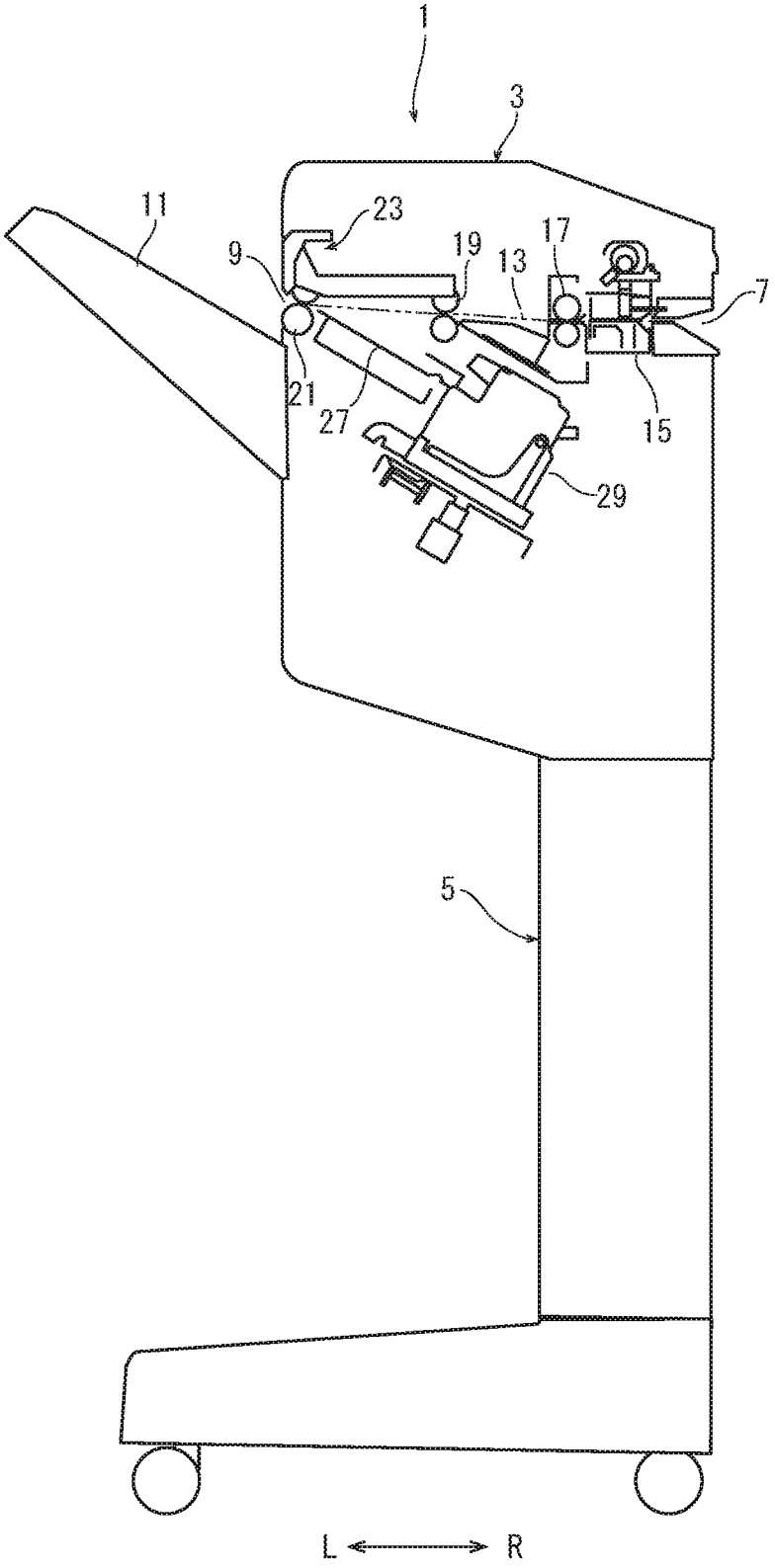
FIG. 1 is a front view schematically showing an inner structure of a sheet processing device according to one embodiment of the present disclosure.

Firstly, with reference to FIG. 1, an entire structure of the sheet processing device 1 will be described. FIG. 1 is a front view schematically showing an inner structure of the sheet processing device 1. In the following description, a near side (a front side) of a paper surface of FIG. 1 is defined to be a front side of the sheet processing device 1. In each figure, L and R respectively show a left side and a right side of the sheet processing device 1. The sheet processing device 1 is disposed adjacent to an inkjet type image forming apparatus, and performs a stapling processing on a stack of sheets to which an image is formed by the image forming apparatus, for example.

The sheet processing device 1 includes an approximately parallelepiped main body part 3 and a leg part 5 which supports the main body part 3. The main body part 3 is formed with a receiving port 7 on one side face (the right side face) on a side of the image forming apparatus. To the receiving port 7, the sheet on which the image is formed is received from the image forming apparatus. The main body part 3 is formed with a discharge port 9 on the other side face (the left side face) on an opposite side to the image forming apparatus. Through the receiving port 9, the processed sheet is discharged. Below the discharge port 9, a discharge tray 11 is disposed. On the discharge tray 11, the sheet discharged through the discharge port 9 is stacked.

In the main body part 3, a conveyance path 13 along which the sheet is conveyed is formed from the receiving port 7 to the discharge port 9. The main body part 3 is provided with a punching device 15 which performs a punching processing on the sheet, a resist rollers pair 17, a conveyance rollers pair 19 and a discharge rollers pair 21 which are disposed along the conveyance path 13 in the order from the upstream side in the conveyance direction.

The main body part 3 is provided with a processing tray 27 and a stapler 29 which are disposed below the conveyance path 13. The processing tray 27 is supported in a downwardly inclined posture from the discharge port 9. On the processing tray 27, the sheet switched back through the discharge port 9 is stacked to form a stack of a predetermined number of the sheets. The stapler 29 as a processing unit is disposed below the processing tray 27, and performs a stapling processing to staple the stack of sheets on the processing tray 27. Furthermore, the main body part 3 is provided with an interlock mechanism 23 which stops the performing of the staling processing by the stapler 29 when it is detected that a foreign matter enters through the discharge port 9.

Next, the stapling processing by the sheet processing device 1 will be described. Firstly, a pre-processing is performed. In the pre-processing, a predetermined number of sheets are stacked on the processing tray 27 to form a stack of the sheets. The sheet on which the image is formed by the image forming apparatus is received through the receiving port 7, and then conveyed along the conveyance path 13. Then, after switched back at the discharge port 9 by the discharge rollers pair 21, the sheet is conveyed to the processing tray 27 and then stacked on the processing tray 27. After a predetermined number of the sheets are stacked on the processing tray 27, the sheets are aligned in a width direction perpendicular to the conveyance direction of the sheet by side cursors and then a stack of the sheets is formed. After the pre-processing, the stapler 29 performs the stapling processing on the stack of sheets. The stapled stack of sheets is discharged through the discharge port 9 by a discharge mechanism (not shown) provided in the processing tray 27 and then stacked on the discharge tray 11.

Next, with reference to FIG. 2 to FIG. 6, the conveyance rollers pair 19, the discharge rollers pair 21 and the interlock mechanism 23 will be described. FIG. 2 to FIG. 6 are front views showing the conveyance rollers pair 19, the discharge rollers pair 21 and the interlock mechanism 23.

The conveyance rollers pair 19 includes an upper roller 19*a* and a lower roller 19*b* disposed on both sides of the conveyance path 13 in the upper-and-lower direction. The conveyance rollers pair 19 is disposed at a predetermined interval from the resist rollers pair 17 (refer to FIG. 1). The lower roller 19*b* is connected to a drive source (not shown) to be rotated. When the lower roller 19*b* is driven by the drive source to be rotated, the upper roller 19*a* is driven by the lower roller 19*b* to be rotated. As a result, the sheet is conveyed in the conveyance direction.

The discharge rollers pair 21 includes an upper roller 21*a* and a lower roller 21*b* disposed on both sides of the conveyance path 13 in the upper-and-lower direction. The discharge rollers pair 21 is disposed inside the discharge port 9. Each of the upper roller 21*a* and the lower roller 21*b* is connected to a drive source (not shown) to be rotated in a normal direction and a reverse direction. When the upper and lower rollers 21*a* and 21*b* are driven by the drive sources to be rotated in the normal direction, the sheet is conveyed in the conveyance direction. When the upper and lower rollers 21*a* and 21*b* are driven by the drive sources to be rotated in the reverse direction, the sheet is switched back in an opposite direction to the conveyance direction.

The upper roller 19*a* of the conveyance rollers pair 19 and the upper roller 21*a* of the discharge rollers pair 21 are supported by a supporting arm 31. The lower roller 19*b* of the conveyance rollers pair 19 and the lower roller 21*b* of the discharge rollers pair 21 are supported by the main body part 3.

The supporting arm 31 is disposed above the conveyance path 13 between the conveyance rollers pair 19 and the discharge rollers pair 21. On the upper face of the supporting arm 31, a projection 33 is formed on the downstream end portion in the conveyance direction. The supporting arm 31 is turned upwardly and downwardly around near a rotational shaft of the upper roller 19*a* of the conveyance rollers pair 19 between a first position where the upper roller 21*a* of the discharge rollers pair 21 comes into contact with the lower roller 21*b* and a second position where the upper roller 21*a* separates from the lower roller 21*b*. In the first position, the discharge port 9 is closed and the sheet on the processing tray 27 is held between the upper roller 21*a* and the lower roller 21*b*. In the second position, the upper roller 21*a* separates from the sheet and the discharge port 9 is opened.

The interlock mechanism 23 includes an actuator 41, a switch 43 and a switch moving mechanism 45. In FIG. 2 to FIG. 6, the interlock mechanism 23 is disposed on the near side (the front side) of the supporting arm 31 on the paper surface of FIG. 1.

The actuator 41 is a plate-shaped member having the same size as the width of the discharge port 9. The actuator 41 has rotational fulcrums 51 on the upper end edges of both the side ends (the front and rear side faces). Additionally, the actuator 41 has a plate-shaped detection piece 53 bent at almost right angles from the upper end portion of the one side end (the front side face) in a side view. The actuator 41 is supported above the discharge port 9 and outside the supporting arm 31 in a turnable manner around the rotational fulcrums 51, and is suspended so as to close the discharge port 9. The above posture of the actuator 41 is called a suspended posture. The detection piece 53 extends toward the inside of the main body part 3 in almost the horizontal direction. Between the lower end edge of the actuator 41 and the lower roller 21*b* of the discharge rollers pair 21, a gap through which the sheet can be passed is formed.

Figure 2:
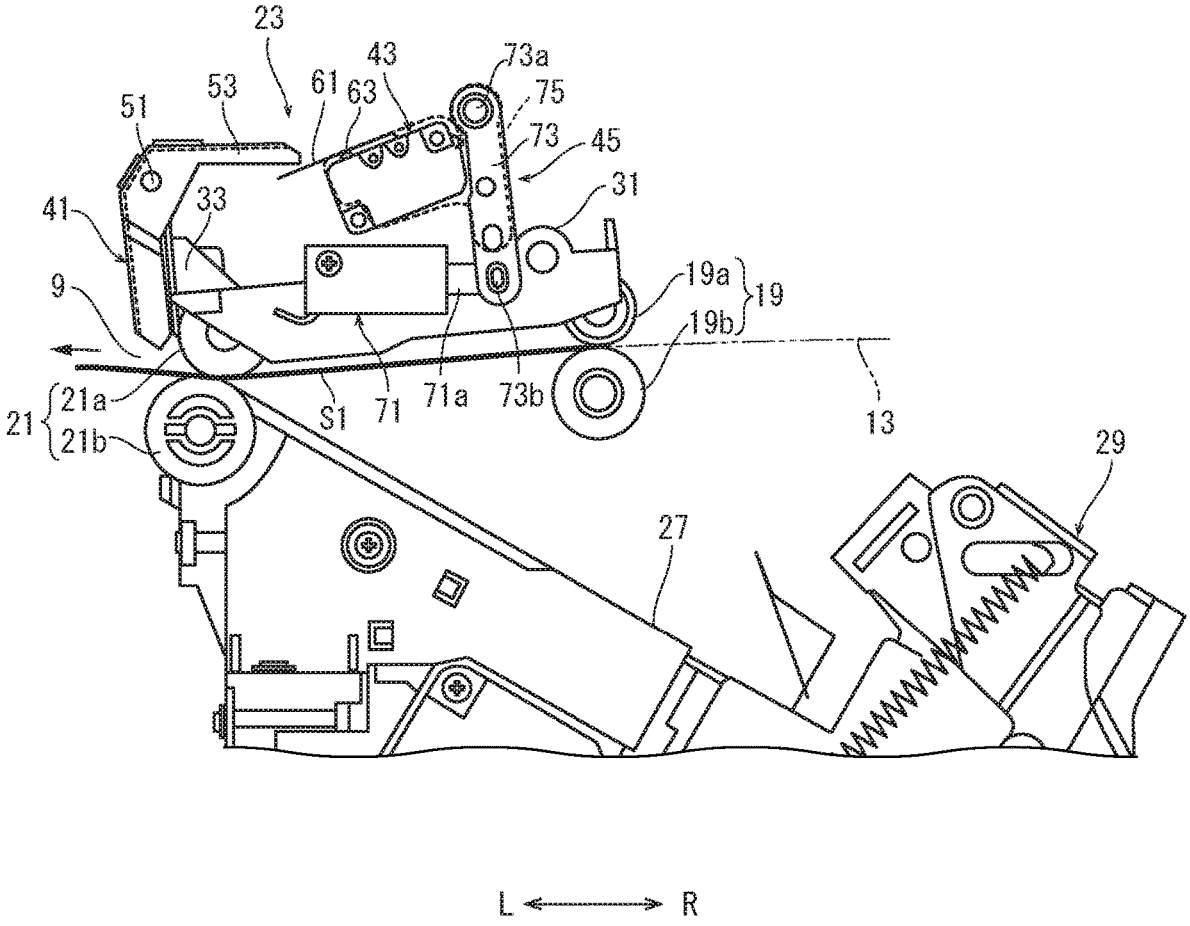
FIG. 2 is a front view showing an interlock mechanism when a first sheet is conveyed, in the sheet processing device according to the embodiment of the present disclosure.

As shown in FIG. 2, in a state where the supporting arm 31 is turned downwardly, the inner face of the actuator 41 faces the outer face of the supporting arm 31. Thereby, if the actuator 41 will be turned inwardly, the inner face of the actuator 41 comes into contact with the outer face of the supporting arm 31 to restrict the actuator 41 from being turned from the suspended posture.

Figure 4:
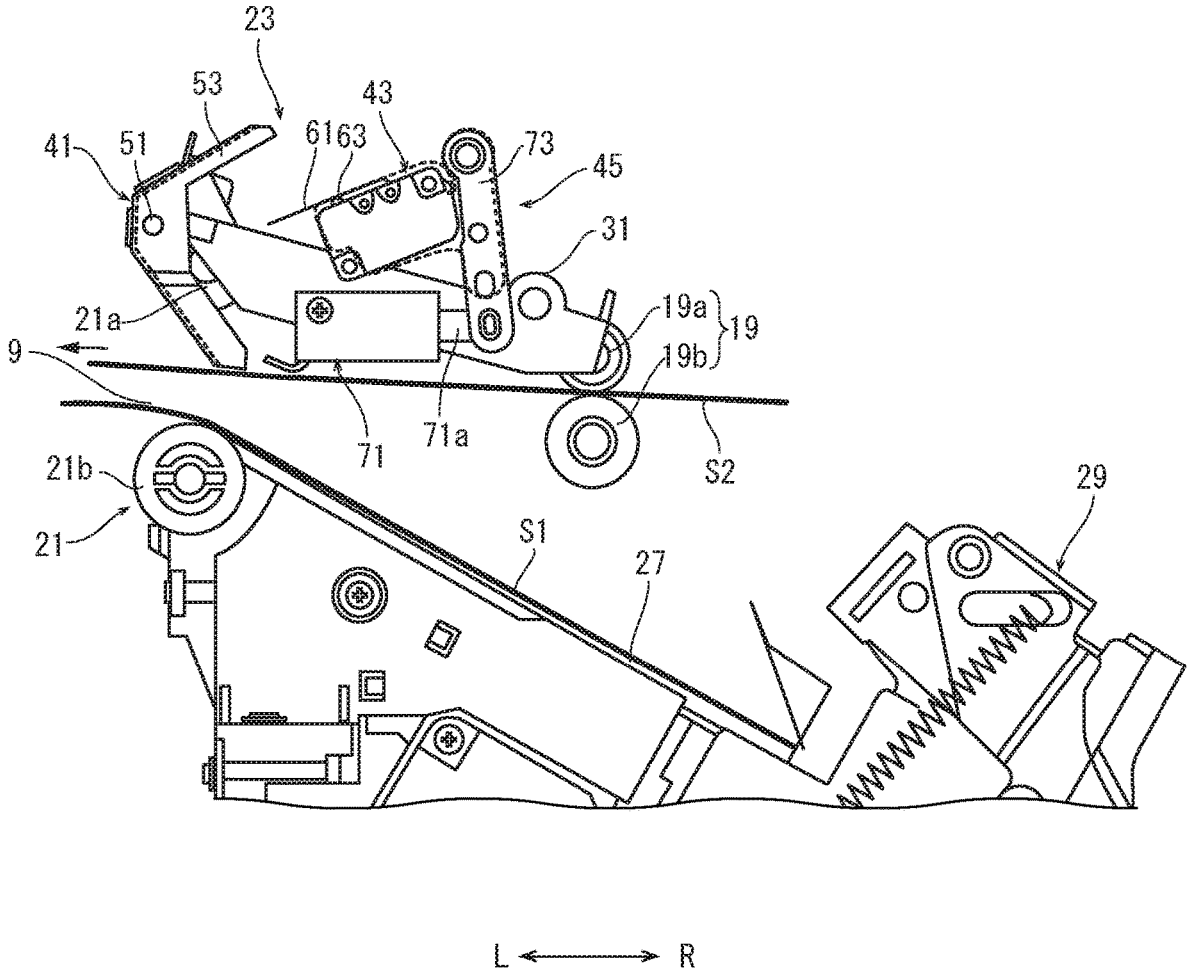
FIG. 4 is a front view showing the interlock mechanism when a second sheet is conveyed, in the sheet processing device according to the embodiment of the present disclosure.

On the other hand, as shown in FIG. 4, if the supporting arm 31 is turned upwardly by an angle larger than a predetermined angle, the projection 33 of the supporting arm 31 comes into contact with a protrusion protruding inwardly from the upper end edge of the actuator 41, and pushes up the actuator 41. Then, the actuator 41 is turned upwardly around the rotational fulcrums 51 to open the discharge port 9. When the actuator 41 is turned as described above, the detection piece 53 extends from the upper end portion of the one side end (the front side face) in an upward oblique direction toward the inside of the main body part 3. By the above turning of the actuator 41, the detection piece 53 is turned within a turning region between the posture along the approximately horizontal direction (refer to FIG. 2) and the posture along the upward oblique direction (refer to FIG. 4).

With reference to FIG. 2 again, the switch 43 is a contact type switch, and has a turnable lever 61 and a switch button 63 depressed by the lever 61. When the lever 61 is pushed down to depress the switch button 63, the switch 43 is switched from an OFF state to an ON state. When the pushing of the lever 61 is released to return the switch button 63, the switch 43 is switched from the ON state to the OFF state. The switch 43 is electrically connected to the stapler 29. The stapler 29 is controlled to be operative (capable of performing the stapling processing) when the switch 43 is switched from the OFF state to the ON state and to be inoperative when the switch 43 is switched from the ON state to the OFF state.

The switch moving mechanism 45 includes a solenoid 71 and a link 73 which couples the solenoid 71 to the switch 43. The switch moving mechanism 45 is disposed inside the front end portion of the discharge port 9 such that the switch 43 corresponds to the detection piece 53 of the actuator 41.

The solenoid 71 is disposed in a posture where a rod 71*a* is drawn leftward (to a side of the discharge port 9).

The upper end 73*a* of the link 73 is supported by the main body part 3 in a rotatable manner. The lower end 73*b* of the link 73 is coupled to the tip end of the rod 71*a* of the solenoid 71 in a rotatable manner. The link 73 is fixed to the switch 43 by a fixed plate 75.

When the rod 71*a* is extended or contracted by energization and non-energization of the solenoid 71, the link 73 is turned around the upper end 73*a* to move the switch 43 between a non-detective position and a detective position together with the link 73. When the solenoid 71 is not energized and the rod 71*a* is extended (refer to FIG. 2 to FIG. 4), the switch 43 is moved to the non-detective position. When the solenoid 71 is energized and the rod 71*a* is contracted (refer to FIG. 5 to FIG. 6), the switch 43 is moved to the detective position.

In the non-detective position (refer to FIG. 2 to FIG. 4), the lever 61 of the switch 43 does not interfere with the turning region of the detection piece 53 of the actuator 41 and does not bring into contact with the detection piece 53. That is, the switching of the switch 43 by the detection piece 53 becomes impossible. In detail, the lever 61 is positioned below the lower limit position (the detection piece 53 is in the posture along the approximately horizontal direction) of the turning region of the detection piece 53. As described, in the non-detective position, the switch 43 cannot detect the actuator 41.

In the detective position (refer to FIG. 5 to FIG. 6), the lever 61 of the switch 43 interferes with the turning region of the detection piece 53 of the actuator 41 and is capable of bringing into contact with the detection piece 53. That is, the switching of the switch 43 by the detection piece 53 becomes impossible. In detail, the lever 61 is positioned above the lower limit position of the turning region of the detection piece 53. When the actuator 41 is turned to the suspended position to position the detection piece 53 in the lower limit position, the lever 61 enters the detection piece 53 and then is pushed downwardly to depress the switch button 63. On the other hand, when the actuator 41 is turned from the suspended posture to position the detection piece 53 above the lower limit position, the detection piece 53 is separated from the lever 61, the depressing of the switch button 63 by the lever 61 is released and then the switch button 63 is returned. As described, in the detective position, the switch 43 can detect the actuator 41.

The sheet processing device 1 includes a controller 30. The controller 30 is electrically connected to the stapler 29, the conveyance rollers pair 21, the supporting arm 31 and the solenoid 71 of the switch moving mechanism 45, and controls their operations. The controller 30 is electrically connected to the switch 43 of the interlock mechanism 23, and the ON state and the OFF state are input to the controller 30 from the switch 43.

An operation of the interlock mechanism 23 having the above described configuration will be described with reference to FIG. 2 to FIG. 6. At the stapling processing, as described above, the pre-processing where a predetermined number of sheets are stacked on the processing tray 27 to form a stack of sheets is performed. In an initial state shown in FIG. 2, when the first sheet S1 is conveyed in the conveyance direction shown by an arrow in FIG. 2, the supporting arm 31 is turned downwardly and the upper roller 21*a* of the discharge rollers pair 21 comes into contact with the lower roller 21*b*. The actuator 41 is turned in the suspended posture. The solenoid 71 is not energized and the switch 43 is moved to the non-detective position. Accordingly, while the actuator 41 is turned in the suspended posture to position the detection piece 53 to the lower limit position, the lever 61 of the switch 43 does not interface with the turning region of the detection piece 53 of the actuator 41. That is, because the switching of the switch 43 from the OFF state to the ON state is impossible, the stapler 29 is inoperative. The lower roller 19*b* of the conveyance rollers pair 19 and the upper and lower rollers 21*a* and 21*b* of the discharge rollers pair 21 are rotated in the normal direction to convey the first sheet S1 along the conveyance path 13 in the conveyance direction.

Figure 3:
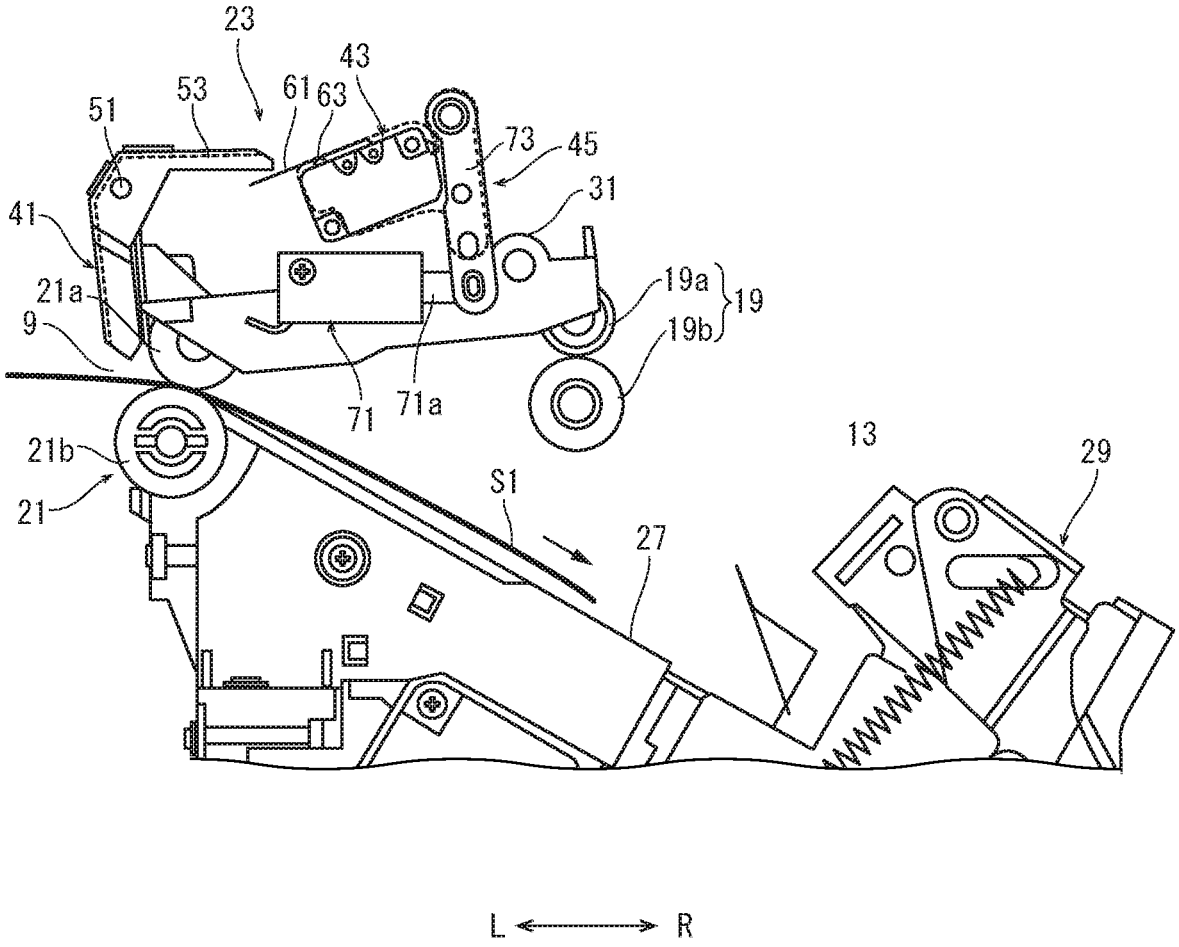
FIG. 3 is a front view showing the interlock mechanism when the first sheet is switched back, in the sheet processing device according to the embodiment of the present disclosure.

As shown in FIG. 3, after the rear edge of the first sheet S1 is separated from the conveyance rollers pair 19, the upper and lower rollers 21*a* and 21*b* of the discharge rollers pair 21 are rotated in the reverse direction to switch back the first sheet S1 in the switchback direction shown in an arrow in FIG. 3. The switched back first sheet S1 is stacked on the processing tray 27.

As shown in FIG. 3, when the second sheet S2 is conveyed, the supporting arm 31 is turned upwardly by the predetermined angle. Thereby, the upper roller 21*a* of the discharge rollers pair 21 is separated from the lower roller 21*b* and the actuator 41 is pushed upwardly by the supporting arm 31 to open the discharge port 9. Then, the lower roller 19*b* of the conveyance rollers pair 19 is rotated in the normal direction to convey the second sheet S2 along the conveyance path 13 in the conveyance direction shown by an arrow in FIG. 4. At this time, the solenoid 71 is not energized and the switch 43 is moved to the non-detective position. Therefore, the switching of the switch 43 from the OFF state to the ON state is impossible and the stapler 29 is inoperative.

After the rear edge of the second sheet S2 is separated from the conveyance rollers pair 19, the supporting arm 31 is turned downwardly and the upper rollers 21*a* of the discharge rollers pair 21 comes into contact with the second sheet S2. At the same time, the actuator 41 is turned in the suspended posture. After that, the upper roller 21*a* of the discharge rollers pair 21 is rotated in the reverse direction to switch back the second sheet S2. The switched back second sheet S2 is stacked on the first sheet S2 on the processing tray 27.

Figure 5:
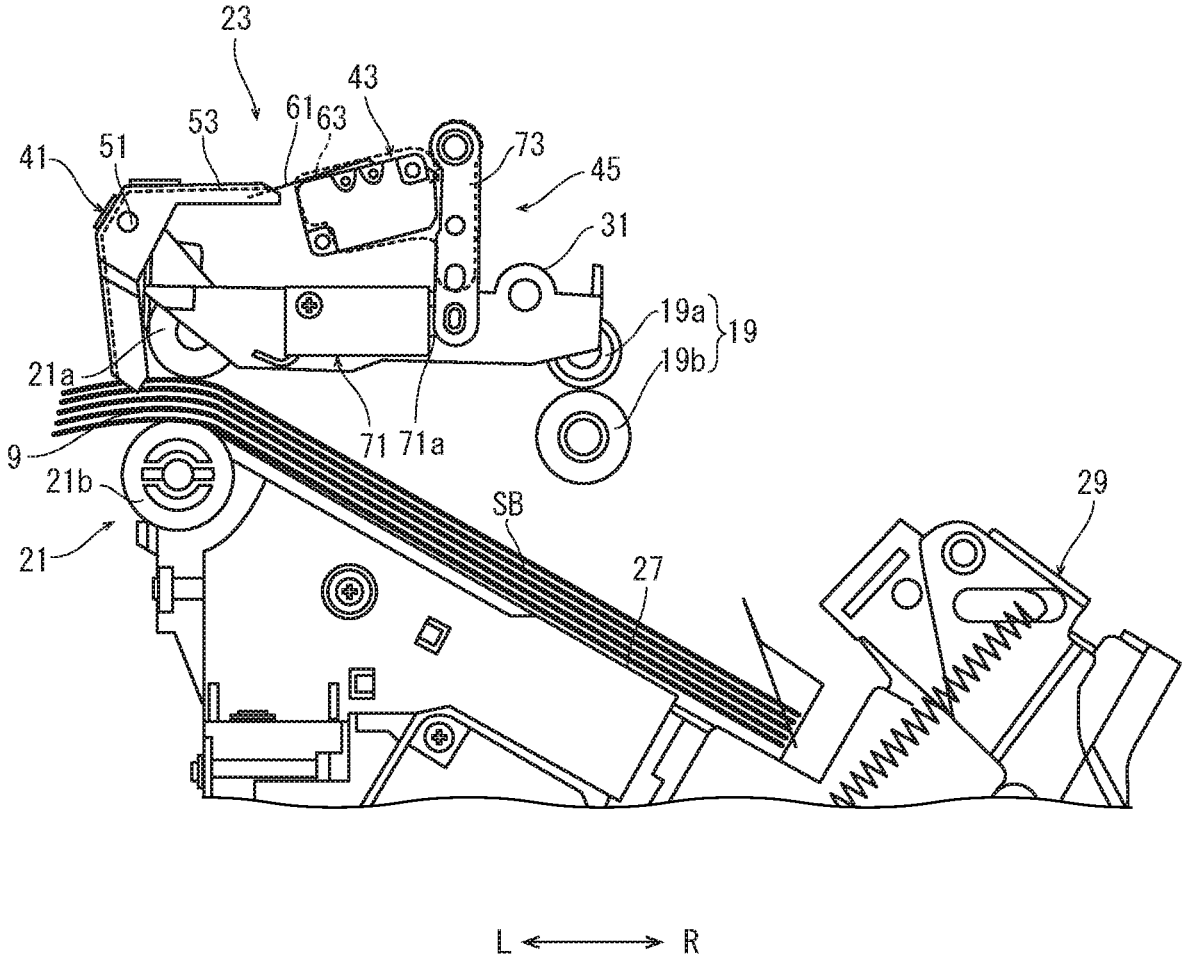
FIG. 5 is a front view showing the interlock mechanism when a stapling processing is performed, in the sheet processing device according to the embodiment of the present disclosure.

After the pre-processing where a predetermined number of the sheets S are stacked on the processing tray 27 to form a stack of sheets SB, the stapler 29 performs the stapling processing on the stack of sheets SB. At this time, as shown in FIG. 5, the supporting arm 31 is turned downwardly, and the upper roller 21*a* of the discharge rollers pair 21 comes into contact with the uppermost sheet of the stack of sheets SB. That is, the supporting arm 31 is turned more upwardly by the thickness of the stack of sheets SB than the initial state shown in FIG. 2. However, because the turning angle of the supporting arm 31 is smaller than the predetermined angle, the actuator 41 is kept in the suspended posture.

When the stapling processing is performed, the solenoid 71 is energized to move the switch 43 from the non-detective position to the detective position. Then, as described above, the lever 61 of the switch 43 is relatively pushed by the detection piece 53 of the actuator 41, and the switch button 63 is depressed by the lever 61 to switch the switch 43 from the OFF state to the ON state. This makes the stapler 29 operative, and the stapling processing is performed on the stack of sheets SB. The stapled stack of sheets SB is discharged through the discharge port 9 by the discharge mechanism and then stacked on the discharge tray 11.

In the state shown in FIG. 5, the supporting arm 31 restricts the turning of the actuator 41. Accordingly, when the switch 43 is moved from the non-detective position to the detective position, the detection piece 53 relatively pushes the lever 61 without being pushed upwardly by the lever 61.

Figure 6:
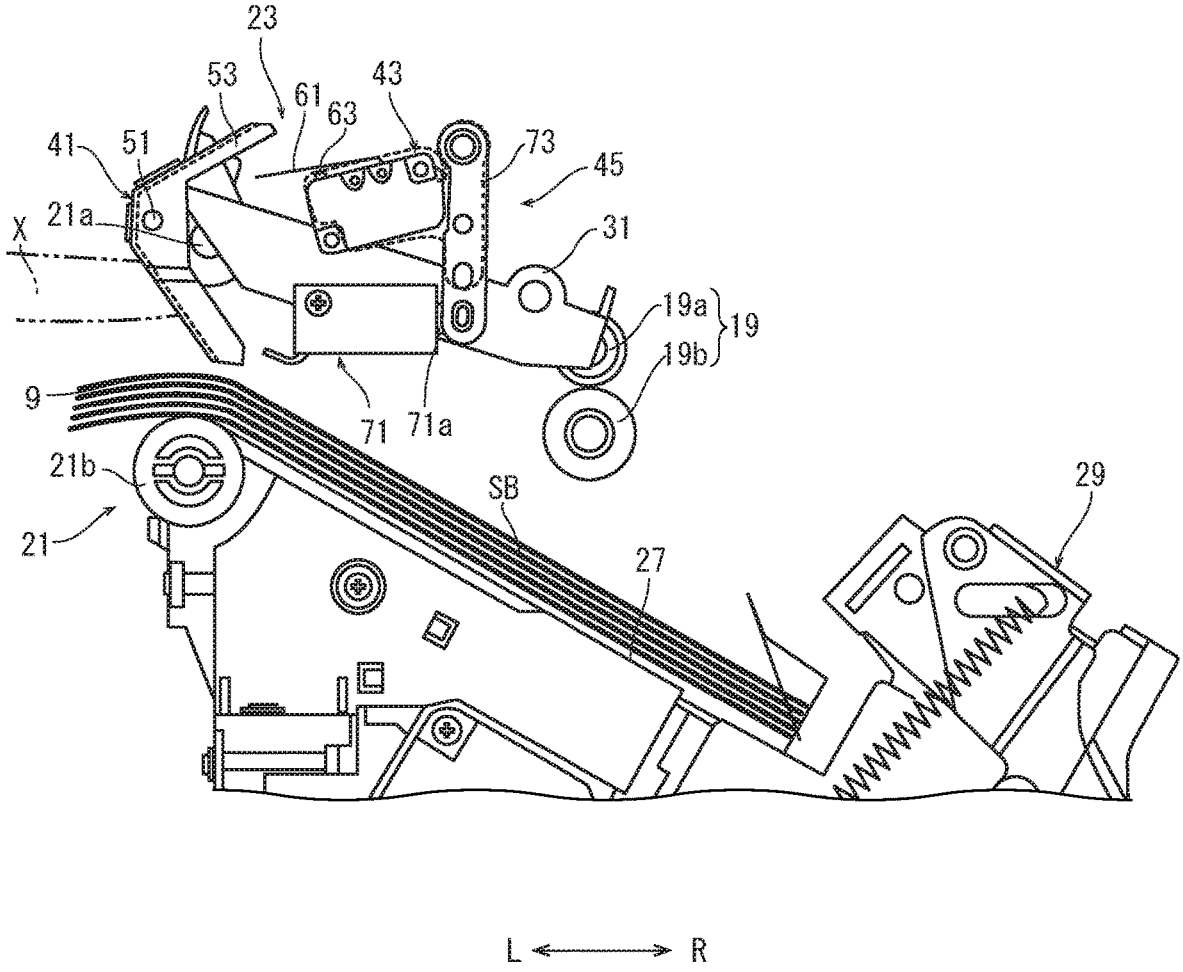
FIG. 6 is a front view showing the interlock mechanism when a foreign matter enters through a discharge port, in the sheet processing device according to the embodiment of the present disclosure.

During the stapling processing, as shown in FIG. 6, in some cases, a finger X may enter above the processing tray 27 through the discharge port 9 accidentally. Then, the supporting arm 31 is pressed by the finger X and then turned upwardly to the second position to push the actuator 41 upwardly. The actuator 41 is turned upwardly from the suspended posture, and the detection piece 53 of the actuator 41 is separated from the lever 61 of the switch 43. Then, the depressing of the switch button 63 by the lever 61 is released, and the switch 43 is switched from the ON state to the OFF state. As a result, the stapler 29 becomes inoperative.

After the stapling processing is performed, the solenoid 71 is non-energized, and the switch 43 is moved from the detective position to the non-detective position.

As understood from the above description, according to the sheet processing device 1 of the present disclosure, the switch 43 is moved to the non-detective position during a period where the stack of sheets is formed (during the pre-processing) while the switch 43 is moved to the detective position during a period where the stapling processing is performed. That is, only a period where the stapling processing is performed, the switching of the switch 43 becomes possible. Then, in one stapling processing, each of the switching from the OFF state to the ON state and the switching from the ON state to the OFF state needs only one time regardless of the number of the sheets of the stack of sheets. Accordingly, compared with a case where the switching is repeated for every time when one sheet is conveyed, it becomes possible to reduce a number of switching of the switch 43. Then, it becomes possible to prolong the life of the switch 43.

Additionally, during the period where the stapling processing is performed, the switch 43 is moved to the detective position where the switch 43 interferes with the turning region of the detection piece 53 of the actuator 41. If the finger or the others accidentally enters through the discharge port 9 in the above state, the supporting arm 31 is pressed by the finger to turn the actuator 41 from the suspended posture and the switch is switched from the ON state to the OFF state. Accordingly, when the foreign matter enters through the discharge port 9 during the period where the stapling processing is performed, it becomes possible to stop the performing of the stapling processing rapidly. When the foreign matter enters through the discharge port 9, the upper roller 21*a* of the discharge rollers pair 21 may be pressed by the foreign matter to turn the actuator 41, or the actuator 41 may be directly pressed by the foreign matter to be turned.

Additionally, because of the contact type switch 43, it becomes possible for the switch 43 to be switched to the ON state and the OFF state stably by the depressing of the switch button 63 by the actuator 41 and the release of the depressing.

In the present embodiment, using the solenoid makes it possible to move the switch 43 to the detective position and the non-detective position by a simple structure.

Additionally, when the solenoid 71 is energized, the switch 43 is moved from the non-detective position to the detective position. Then, if the solenoid 71 is damaged, the switch 43 is moved to the non-detective position and the OFF state of the switch 43 is kept such that the stapling processing becomes inoperative. Accordingly, even if the finger accidentally enters through the discharge port 9, the stapling processing is not performed so that the safety is obtained. During a period where the stapling processing is not performed, other than the period where the stack of sheets is formed, for example, during a waiting period of the sheet processing device 1, the switch 43 is moved to the non-detective position. Then, even if the finger accidentally enters through the discharge port 9, the stapling processing is not performed.

The embodiment describes the sheet processing device 1 performing the stapling processing; the processing performed by the sheet processing device 1 contains a punching processing and a binding processing in addition to the stapling processing.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A sheet processing device comprising:

a processing tray on which a sheet is stacked;

a processing unit which performs a predetermined processing on the sheet on the processing tray;

a discharge port through which the processed sheet is discharged;

a discharge rollers pair having a lower roller provided in the discharge port and an upper roller facing the lower roller, the discharge rollers pair conveying the sheet on the processing tray;

a supporting arm which supports the upper roller and is provided to be turnable between a first position where the upper roller comes into contact with the sheet and a second position where the upper roller separates upwardly from the sheet; and an interlock mechanism which stops a performing of the processing by the processing unit when a turning of the supporting arm to the second position is detected, wherein the interlock mechanism includes:

an actuator supported in the discharge port in a turnable manner and turned with an upwardly turning of the supporting arm;

a switch which detects the actuator to detect that the supporting arm is turned to the second position; and a switch moving mechanism which moves the switch to an actuator non-detective position and an actuator detective position, wherein the switch moving mechanism moves the switch to the non-detective position while the processing is not performed and moves the switch to the detective position while the processing is performed.

2. The sheet processing device according to claim 1, wherein in a state where the switch is moved to the detective position by the switch moving mechanism, while the processing is performed, the supporting arm is turned to the first position and the switch detects the actuator, and when a foreign matter enters through the discharge port, the supporting arm is turned upwardly to turn the actuator and to separate the actuator from the switch.

3. The sheet processing device according to claim 1, wherein the switch includes a turnable lever and a switch button depressed by the lever, when the actuator turns the lever and the switch button is depressed by the lever, the switch detects the actuator, and when the actuator is separated from the lever and the switch button is returned, the switch does not detect the actuator.

4. The sheet processing device according to claim 3, wherein in a state where the switch is moved to the detective position by the switch moving mechanism, when the actuator turns in conjunction with a turning of the supporting arm to the first position, the switch button is depressed by the lever such that the switch detects the actuator, and when the actuator turns in conjunction with a turning of the supporting arm to the second position, the lever separates from the switch button such that the switch does not detect the actuator.

5. The sheet processing device according to claim 1, wherein the switch moving mechanism includes a solenoid coupled to the switch via a link, when the solenoid is energized, the switch is moved from the non-detective position to the detective position, and when the solenoid is non-energized, the switch is moved from the detective position to the non-detective position.

6. The sheet processing device according to claim 5, wherein the switch moving mechanism turns the switch between the non-detective position and the detective position around one end portion of the link.

7. The sheet processing device according to claim 3, wherein the actuator has a detection piece which comes into contact with the lever at the detective position, and the non-detective position is below a turning region of the detection piece.

8. The sheet processing device according to claim 1, wherein each time where the sheet is stacked on the processing tray, the supporting arm is turned between the first position and the second position.

9. The sheet processing device according to claim 1, wherein the processing unit is a stapler.

10. A sheet processing device comprising:

a processing tray on which a sheet is stacked;

a processing unit which performs a predetermined processing on the sheet on the processing tray;

a discharge port through which the processed sheet is discharged;

a discharge rollers pair having a lower roller provided in the discharge port and an upper roller facing the lower roller, the discharge rollers pair conveying the sheet on the processing tray;

a supporting arm which supports the upper roller and is provided to be turnable between a first position where the upper roller comes into contact with the lower roller to hold the sheet on the processing tray and a second position where the upper roller separates from the lower roller to open the discharge port;

an interlock mechanism which stops a performing of the processing by the processing unit when a turning of the supporting arm to the second position is detected; and a controller which controls the processing unit, the supporting arm and the interlock mechanism, wherein the interlock mechanism includes:

a switch which detects the turning of the supporting arm to the second position; and a switch moving mechanism which moves the switch to an actuator non-detective position and an actuator detective position, wherein the controller controls the supporting arm so as to perform a pre-processing where the supporting arm is turned to the second position to receive the sheet between the upper roller and the lower roller every time when the sheet is conveyed, and then turned to the first position to convey and stack the received sheet on a predetermined position on the processing tray, controls the processing unit to perform the processing on the stacked sheet after the pre-processing, and controls the switch moving mechanism to move the switch to the non-detective position during the pre-processing and to move the switch to the detective position when the processing is performed.

* * * * *